US007566229B2

(12) United States Patent
Ma

(10) Patent No.: US 7,566,229 B2
(45) Date of Patent: Jul. 28, 2009

(54) ELECTRICAL CONNECTOR ASSEMBLY WITH REINFORCING FRAME

(75) Inventor: Hao-Yun Ma, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/825,226

(22) Filed: Jul. 5, 2007

(65) Prior Publication Data

US 2008/0009188 A1 Jan. 10, 2008

(30) Foreign Application Priority Data

Jul. 4, 2006 (CN) ..... 2006 2 0074742

(51) Int. Cl.
*H01R 12/00* (2006.01)

(52) U.S. Cl. ..... 439/71

(58) Field of Classification Search ..... 439/68, 439/69, 70, 71, 73, 66

See application file for complete search history.

(56) References Cited

U.S. PATENT DOCUMENTS

| | | | | |
|---|---|---|---|---|
| 6,419,513 | B1 * | 7/2002 | Choy | 439/326 |
| 7,056,130 | B1 | 6/2006 | McAlonis et al. | |
| 2005/0215087 | A1 * | 9/2005 | Asai et al. | 439/71 |
| 2005/0239302 | A1 * | 10/2005 | Wada | 439/71 |

* cited by examiner

*Primary Examiner*—Ross N Gushi
(74) *Attorney, Agent, or Firm*—Wei Te Chung

(57) ABSTRACT

An electrical connector assembly includes an insulative housing (1), and a reinforcing frame (4) removably disposed on the insulative housing. The insulative housing includes a base (10) having a top side, and side walls (11) upwardly extending from the top side of the base, with a datum protrusion (111) formed on each of the side walls. The reinforcing frame includes a plurality of reinforcing pieces (41) located laterally on outer faces of the datum protrusions. The providence of the reinforcing pieces adjacent the datum protrusions can prevent the damage of the datum protrusions or portions of the side walls around the datum protrusions during the not-properly loading or removable process of an IC package onto the insulative housing.

10 Claims, 6 Drawing Sheets

ELECTRICAL CONNECTOR ASSEMBLY WITH REINFORCING FRAME

BACKGROUND OF THE INVENTION

1. Field of the Invention

The present invention relates to the art of electrical connectors, and more particularly to an electrical connector assembly including a reinforcing frame for reinforcing an electrical connector body.

2. Description of the Related Art

One conventional electrical connector assembly is shown in FIGS. 5 and 6 to include an insulative connector body 1" having peripheral side walls 11" adapted to receive an electronic component, such as an IC package 3", and the IC package 3" accommodated within space defined by the peripheral side walls 11'. Typically, the IC package 3" is loaded into the connector body 1" so as to establish electrical continuity between the IC package 3" and a substrate through the use of the connector body 1". When loaded into the connector body 1", the IC package 3" registers on the interior side walls 11" of the connector body 1". If the IC package 3" is not loaded or handled properly, the side walls 11" of the connector body 1" may become cracked or somewhat fragile, thereby causing damage of the connector body 1", which is undesirable to the user of the connector body 1". Therefore, there is a need to provide a new electrical connector assembly to resolve the above-mentioned shortcoming.

SUMMARY OF THE INVENTION

An electrical connector assembly according to one embodiment of the present invention includes an insulative housing adapted to hold a plurality of contacts, and a reinforcing frame removably disposed on the insulative housing. The insulative housing includes a base having a top side, and side walls upwardly extending from the top side of the base, with a datum protrusion formed on each of the side walls. The reinforcing frame includes a plurality of reinforcing pieces located laterally on outer faces of the datum protrusions. The providence of the reinforcing pieces adjacent the datum protrusions can prevent the damage of the datum protrusions or portions of the side walls around the datum protrusions during the not-properly loading or removable process of an IC package onto the insulative housing.

Other features and advantages of the present invention will become more apparent to those skilled in the art upon examination of the following drawings and detailed description of preferred embodiments, in which:

DETAILED DESCRIPTION OF PREFERRED EMBODIMENT

Figure 1:
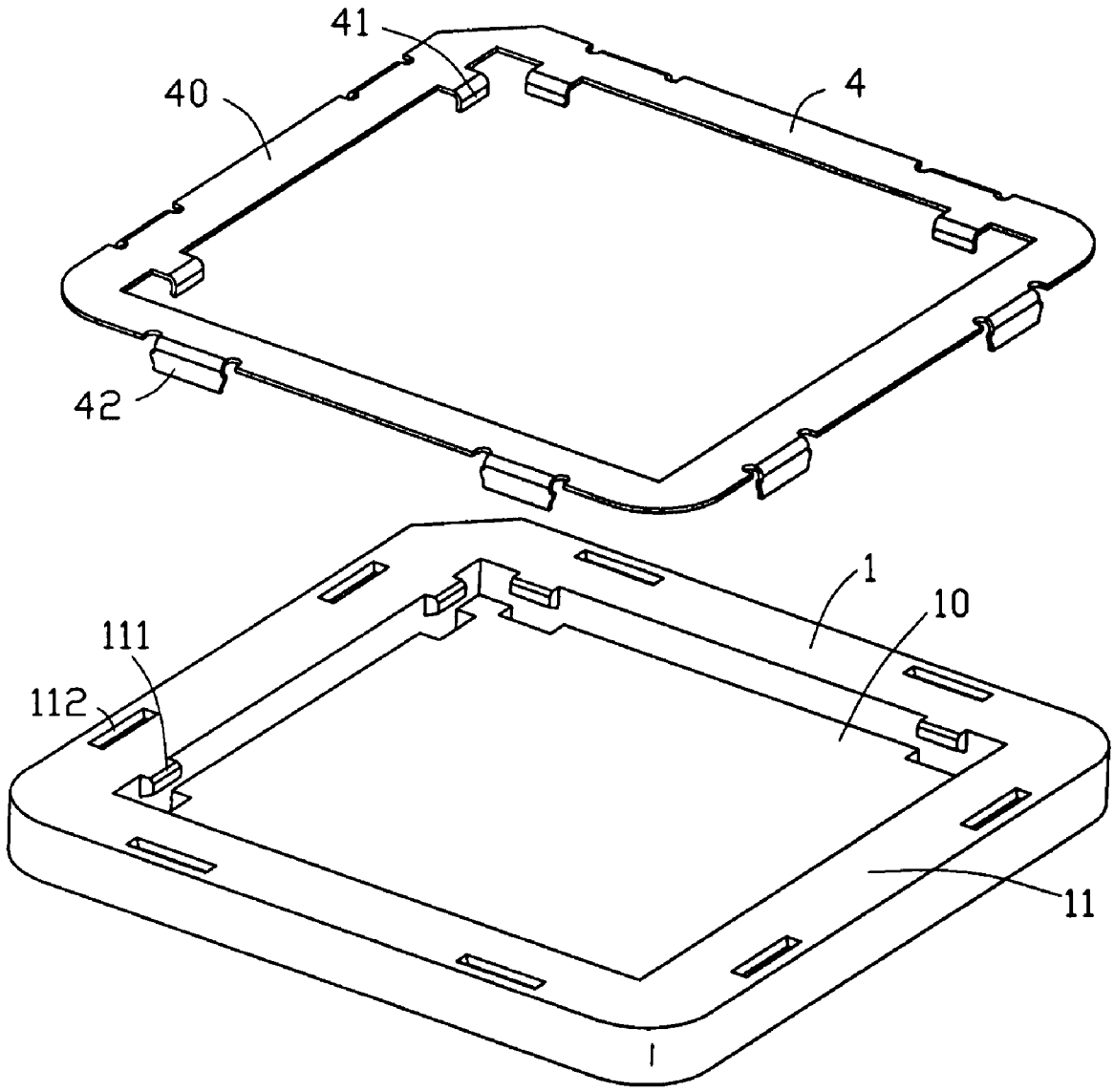
FIG. 1 is an exploded, perspective view of an electrical connector assembly according to a first preferred embodiment of the present invention.
Figure 2:
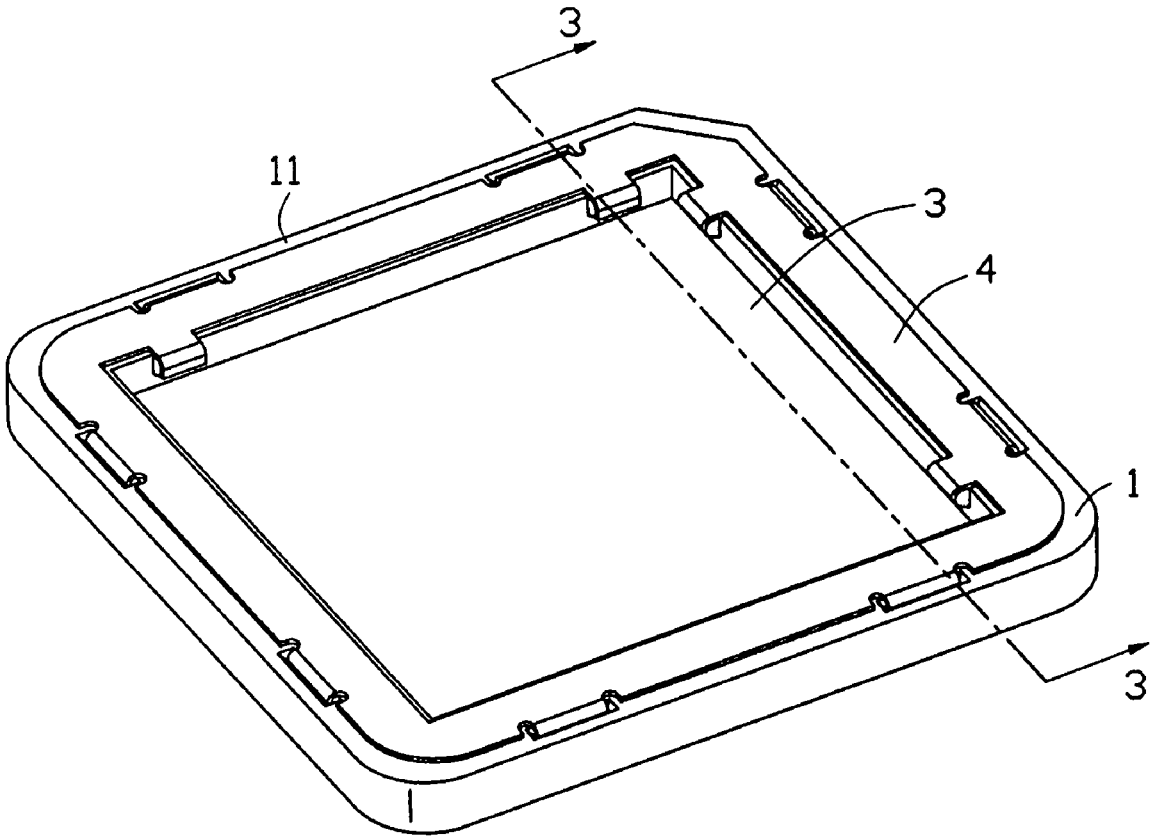
FIG. 2 is an assembled, perspective view of the electrical connector assembly of FIG. 1.
Figure 3:
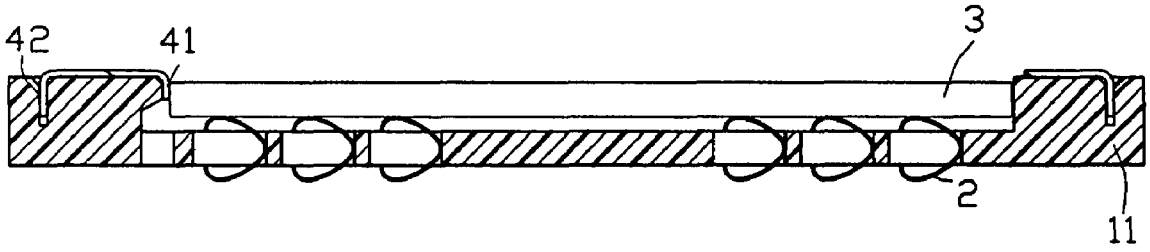
FIG. 3 is a cross sectional view of the electrical connector assembly of FIG. 2 taken along line 3-3 thereof.

Referring to FIGS. 1 to 3, an electrical connector assembly according to the first preferred embodiment is shown to include an insulative housing or connector body 1, and a reinforcing frame or member 4 assembled onto the connector body 1.

The connector body 1 is adapted to hold a plurality of contacts 2 (as known in the prior art). The connector body 1 includes a base wall 10, and four side walls 11 disposed peripheral to the base wall 10, with each side wall 11 generally transverse to the base wall 10. The side walls 11 are configured to extend from a top side of the base wall 10 upwardly so as to define a substantially rectangular cavity adapted for receiving an electronic component, such as an IC package 3. The side walls 11 of the connector body 1 are formed with a plurality of datum protrusions 111, each datum protrusion 111 defining an outer side face laterally toward the interior cavity above the base wall 10, or located inward of the corresponding side wall 11. In this manner, the IC package 3 is forced to register and align on the datum protrusions 111 in the interior side walls 11 of the connector body 1. Opposite pairs of datum protrusions 111 determine datum dimensions used to precisely locate the contacts 2 and the IC package 3 relative to the side walls 11 of the connector body 1. In this embodiment, the side walls 11 of the connector body 1 defines recesses 112 adapted for receiving retention portions 42 of the reinforcing frame 4 so as to form a mechanical interconnection between the connector body 1 and the reinforcing frame 4 by the combination of the recesses 112 of the connector body 11 and the retention portions 42 of the reinforcing frame 4 (to be later described).

In this embodiment, the reinforcing frame 4 is preferably stamped from a metallic sheet. However, in alternative embodiments, the reinforcing frame 4 may be made of any suitable material that can be used to resist lateral pressure caused by not properly loading of the IC package so as to be not damage to the datum protrusions 111 or the side walls 11 of the connector body 1, the suitable material being such as a sheet plated with a metallic layer.

The reinforcing frame 4 is removably disposed on the connector body 1, and includes four extension pieces 40 in correspondence with four side walls 11 of the connector body 1 to be engageable onto respective top surfaces of the four side walls 11, and a plurality of retention portions 42 located at outer edges of the respective extension pieces 40 for being inserted within the recesses 112 of the connector body 1 so as to hold the reinforcing frame 4 onto the connector body 1. The frame 4 includes a plurality of discrete reinforcing elements 41 extending along inner peripheral edges of the respective extension pieces 40 and substantially perpendicular to the extension pieces 40, with each extending from the top surface of the corresponding side wall 11 to adjacent the outer side face of the corresponding datum protrusion 111. More specifically, each of the reinforcing elements 41 is configured to have at least a portion thereof located laterally on the outer side face of each datum protrusion 111, or flanking and disposed parallel to the outer side face of each datum protrusion 111. As compared with the prior art, the providence of the reinforcing elements 41 adjacent the datum protrusions 111 can prevent the damage of the datum protrusions 111 or portions of the side walls 11 around the datum protrusions 111 during the not-properly loading or removable process of the IC package 3 onto the connector body 1.

Referring to FIGS. 1 and 2, in assembly, the reinforcing frame 4 is retained onto the connector body 1 by its retention portions 42 interferingly insertable into the recesses 112 of the connector body 1, such that each reinforcing elements 41 is located laterally on the outer side faces of the respective datum protrusions 111 or flanking the side faces of the respective datum protrusions 111.

Figure 4:
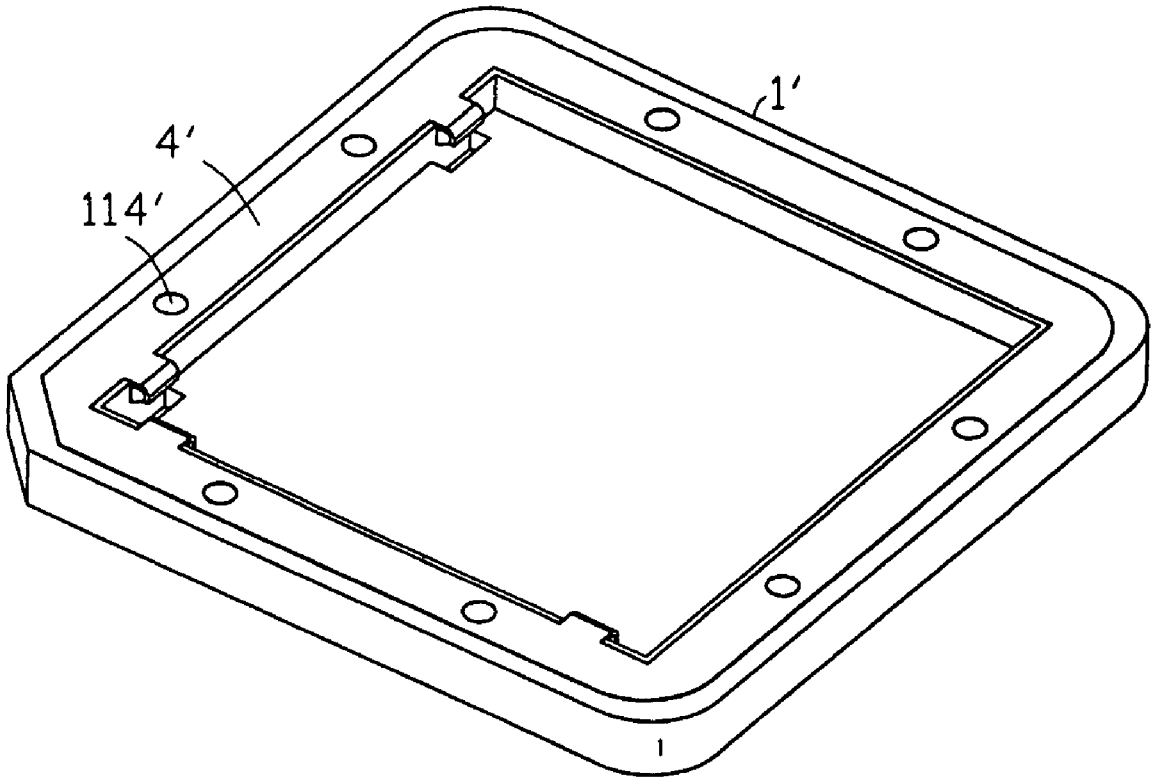
FIG. 4 is an assembled, perspective view of another electrical connector assembly according to a second preferred embodiment of the present invention.
Figure 5:
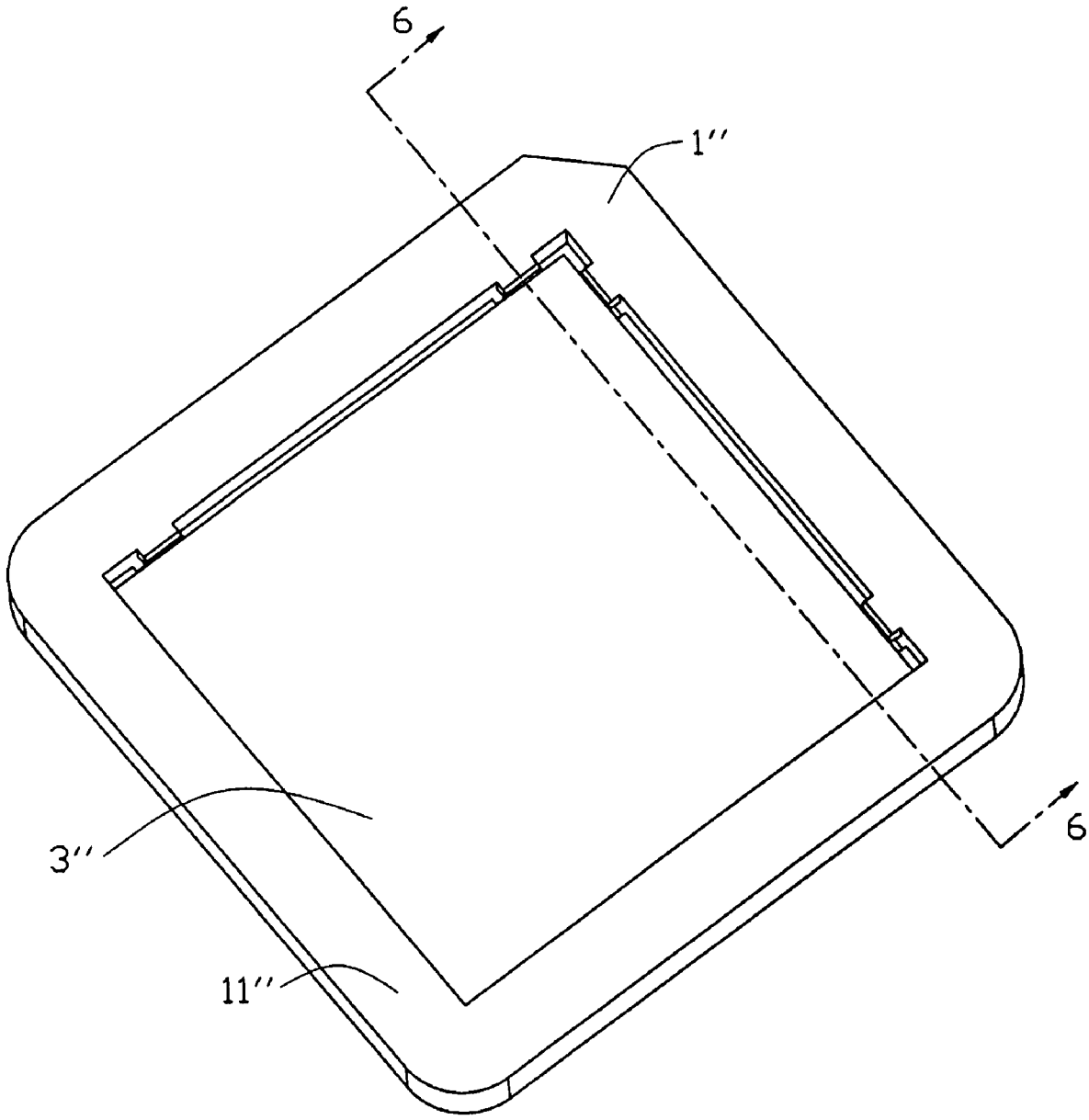
FIG. 5 (PRIOR ART)
FIG. 5 is an assembled, perspective view of a conventional electrical connector assembly, with an IC package assembled therein.
Figure 6:
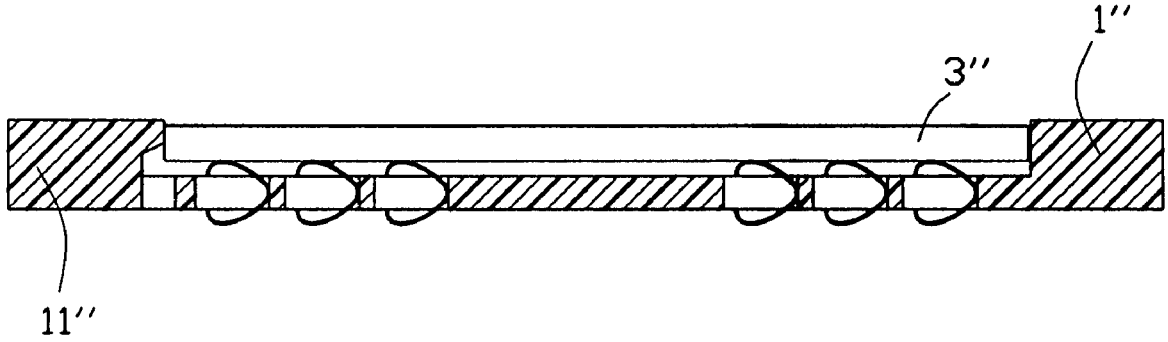
FIG. 6 (PRIOR ART)
FIG. 6 is a cross sectional view of the electrical connector assembly of FIG. 5 taken along line 6-6 thereof.

Referring to FIG. 4, an electrical connector assembly according to the second preferred embodiment of the present invention is shown. The electrical connector assembly of this embodiment is similar to that of the first embodiment, except for interconnection between the reinforcing frame and the connector body. More specifically, the connector body 1' includes retention sections 114' located adjacent peripheral edges of the reinforcing frame 4', and the frame 4' includes recesses (not seen) adapted for receiving the retention sections 114' of the connector body 1' so as to form the mechanical interconnection between the frame 4' and the connector body 1' by the combination of the recesses of the reinforcing frame 4' and the retention sections 114' of the connector body 1'.

While the present invention has been described with reference to preferred embodiments, the description of the invention is illustrative and is not to be construed as limiting the invention. Various of modifications to the present invention can be made to preferred embodiments by those skilled in the art without departing from the true spirit and scope of the invention as defined by the appended claims.

What is claimed is:

1. An electrical connector assembly comprising:

an electrical connector comprising:

an insulative housing holding a plurality of contacts, the insulative housing including a base having a top side, and four side walls upwardly extending from said top side of said base and commonly defining an electronic package receiving cavity;

a datum protrusion located inward on at least one of said side walls and facing the electronic package receiving cavity; and a unitary reinforcing frame disposed on said insulative housing, the frame having at least one datum reinforcing piece located laterally on an outer face of the datum protrusion; wherein said frame includes at least one retention portion downwardly extending into a corresponding vertical recess which is hidden in the housing except in an upward direction, so as to allow the frame to be downwardly assembled to the housing under a condition that the retention is protectively received in the recess and the datum reinforcing piece covers the datum protrusion laterally.

2. The electrical connector assembly of claim 1, wherein the reinforcing frame is made of a metallic material and reinforces said side walls simultaneously.

3. The electrical connector assembly of claim 1, wherein the frame includes an extension piece extending substantially perpendicular to the datum reinforcing piece, the extension pieces located on top surfaces of said side walls.

4. The electrical connector assembly of claim 1, wherein the frame is removable with regard to the housing.

5. The electrical connector assembly of claim 1, wherein an electronic package is received in a cavity surrounded by the side walls under a condition that said electronic package forcibly abuts against the reinforcing piece.

6. The electrical connector assembly of claim 1, wherein said four side walls are all covered by said frame.

7. The electrical connector assembly of claim 1, wherein the insulative housing includes retention sections adjacent peripheral edges of the frame for retaining the frame onto the insulative housing.

8. The electrical connector assembly of claim 7, wherein the frame includes recesses adapted for receiving the retention sections of the insulative housing.

9. The electrical connector assembly of claim 1, wherein the vertical recess is located in said at least one of said side wall.

10. The electrical connector assembly of claim 9, wherein another datum protrusion is formed on another side wall neighboring to said at least one of said side walls, and is facing the electronic package receiving cavity under a condition that said frame further includes another datum reinforcing piece located on an outer face of said another datum protrusion, and further includes another retention protrusion downwardly extending into another corresponding vertical recess which is hidden in the housing except in said upward direction.

* * * * *